US005114355A

United States Patent [19]

Kimmel et al.

[11] Patent Number: 5,114,355

[45] Date of Patent: May 19, 1992

[54] RIGHT ANGLE IMPEDANCE MATCHED ELECTRICAL CONNECTOR

[75] Inventors: David J. Kimmel, Clearwater; Paul P. Siwinski, Seminole; Robert A. Smith, Palm Harbor; Richard E. Thurman, Seminole; Stephen R. Adkins, Clearwater; Steven Feldman, Hudson; Raymond J. Look, New Port Richey, all of Fla.

[73] Assignee: AMP Incorporated, Harrisburg, Pa.

[21] Appl. No.: 662,384

[22] Filed: Feb. 26, 1991

Related U.S. Application Data

[63] Continuation of Ser. No. 519,367, May 4, 1990, abandoned.

[51] Int. Cl.[5] ..... H01R 13/652

[52] U.S. Cl. ..... 439/101; 439/79

[58] Field of Search ..... 439/101, 108, 247, 248, 439/79, 636, 569, 570, 557

[56] References Cited

U.S. PATENT DOCUMENTS

| | | | |
|---|---|---|---|
| 3,218,448 | 11/1965 | Cala | 439/557 |
| 3,601,775 | 8/1971 | Longenecker et al. | 439/636 |
| 3,808,578 | 4/1974 | Hansen | 439/636 |
| 4,109,993 | 8/1978 | Bauerle | 439/695 |
| 4,394,795 | 7/1983 | Goss | 439/892 |
| 4,408,824 | 11/1983 | Weidler | 439/857 |
| 4,687,276 | 8/1987 | Stockmaster | 439/557 |
| 4,695,106 | 9/1987 | Feldman et al. | 439/108 |
| 4,747,787 | 5/1988 | Siwinski | 439/108 |
| 4,762,500 | 9/1988 | Dola et al. | 439/79 |
| 4,824,387 | 4/1989 | de Jong et al. | 439/248 |
| 4,842,552 | 6/1989 | Frantz | 439/573 |

FOREIGN PATENT DOCUMENTS 49-6543 2/1974 Japan .

*Primary Examiner*—Gary F. Paumen

[57] ABSTRACT

Microstrip transmission of electrical signals between two arrays of signal conductors such as two printed circuit boards is maintained in an electrical connector in which signal contacts are disposed on opposite sides of the central ground bus. Signal contacts are urged inwardly into engagement with a central dielectric wall and a ground bus is similarly urged outwardly into engagement with the same wall to establish the microstrip configuration between each row of terminals in the central ground bus. The receptacle connector includes a right angle bend and signal contacts as well as the ground bus also have a right angle bend. The insulative housing of a right angle connector comprises upper and lower housing members which are snapped into engagement. Resilient arms, forming a part of the connector mounting assembly on the upper housing member, engage the lower housing member to hold it in place.

9 Claims, 17 Drawing Sheets

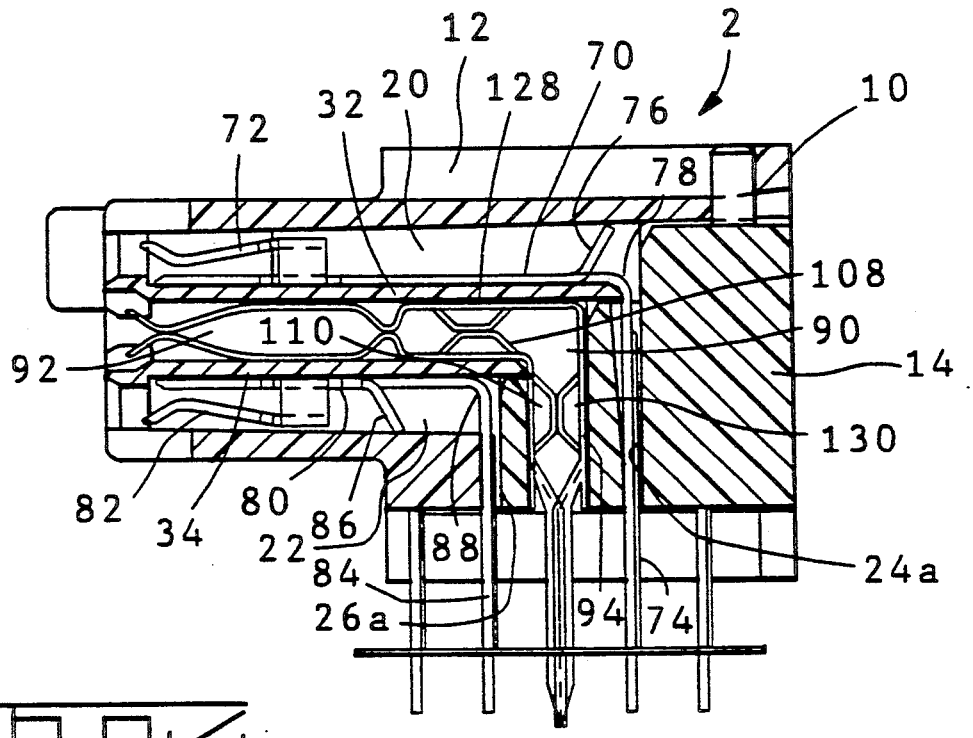
Fig. 4
Fig. 5
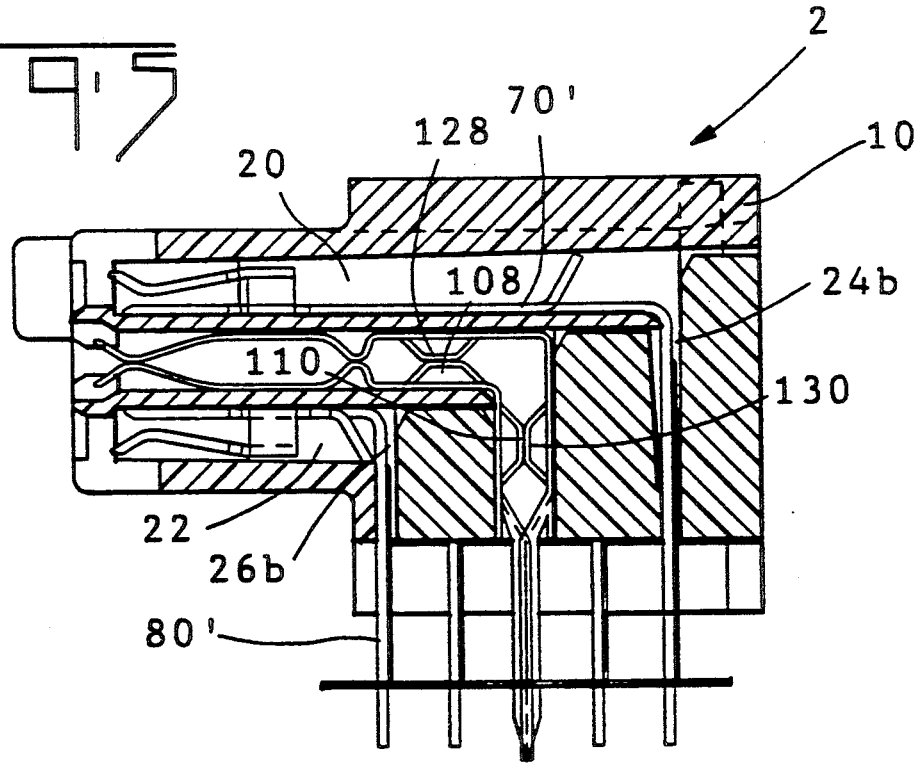

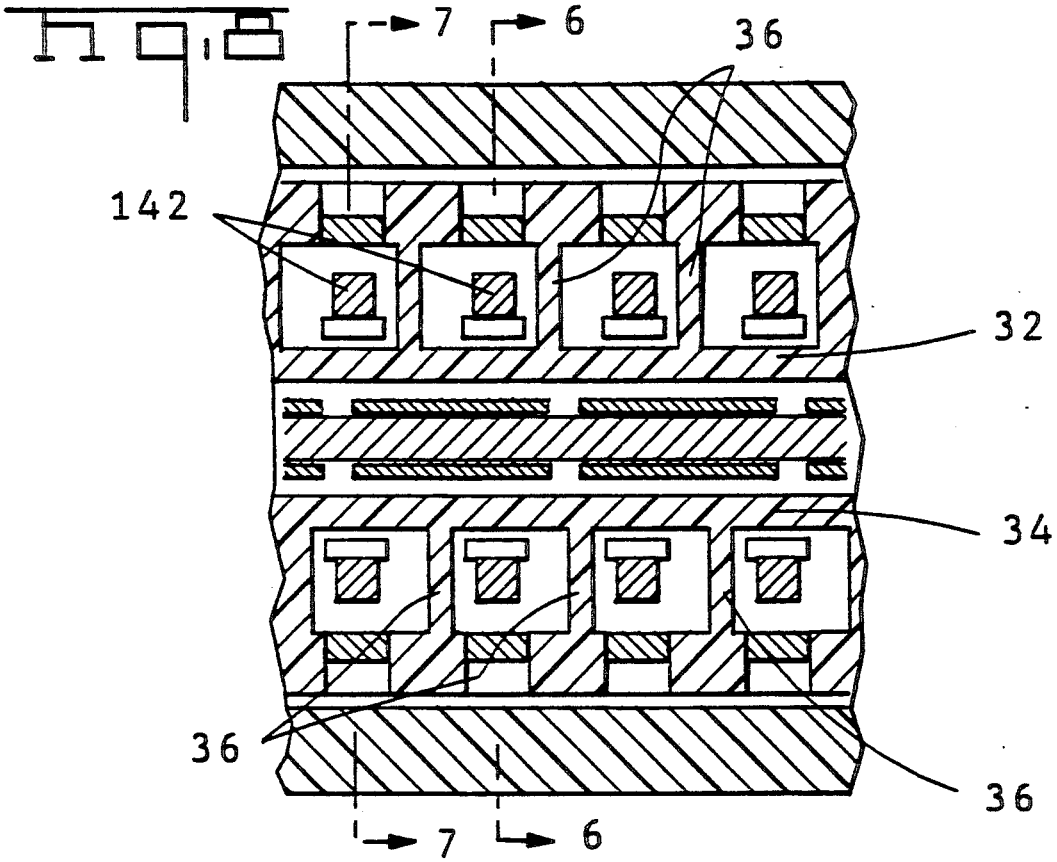
7
6
36
142
32
34
36
36
7
6
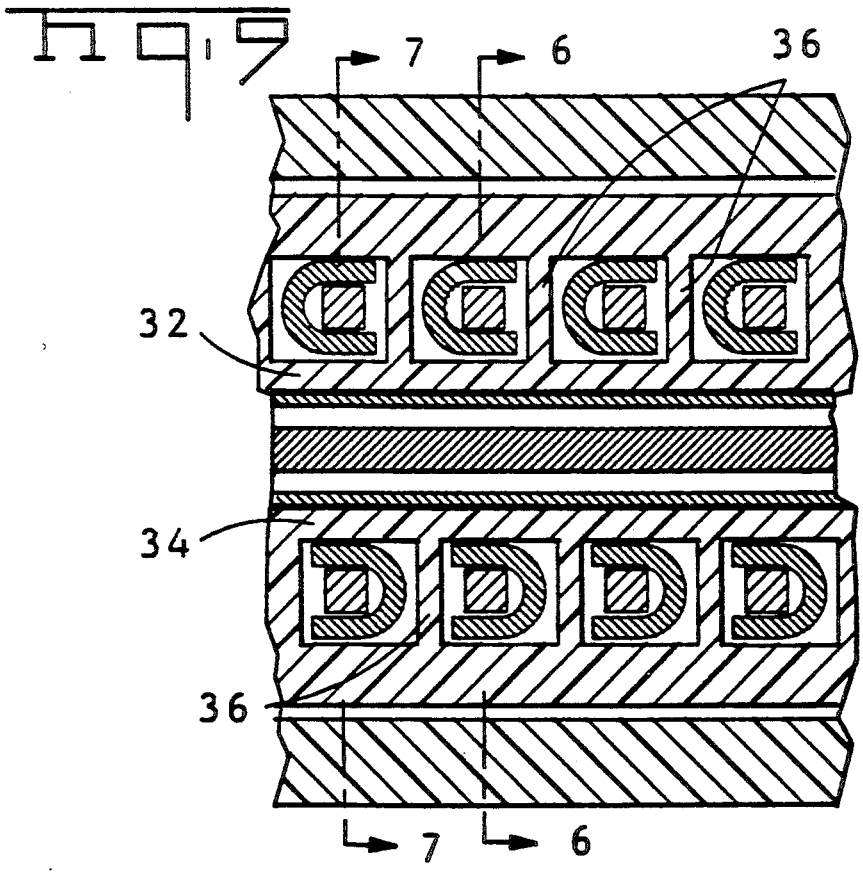
7
6
36
32
34
36
7
6

Fig. 16A
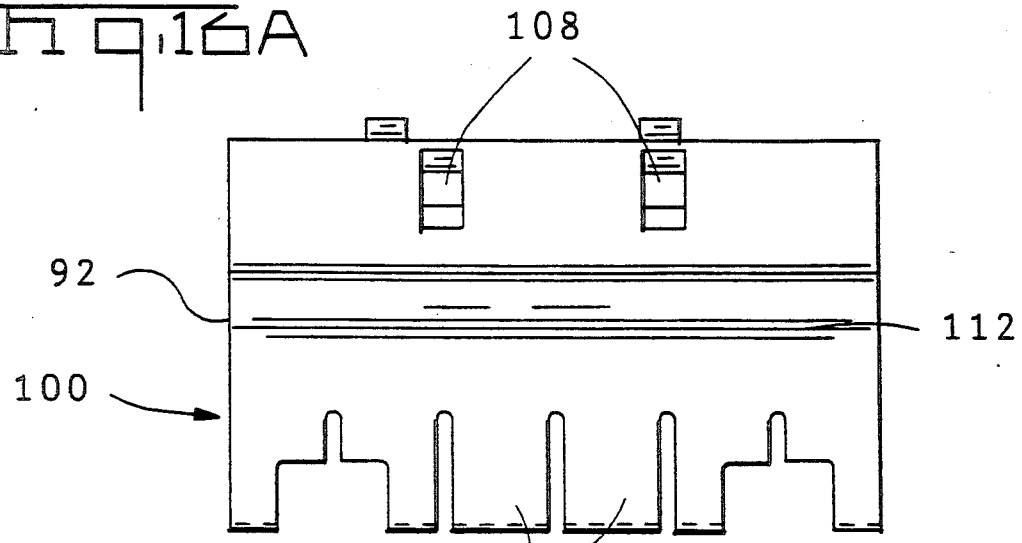
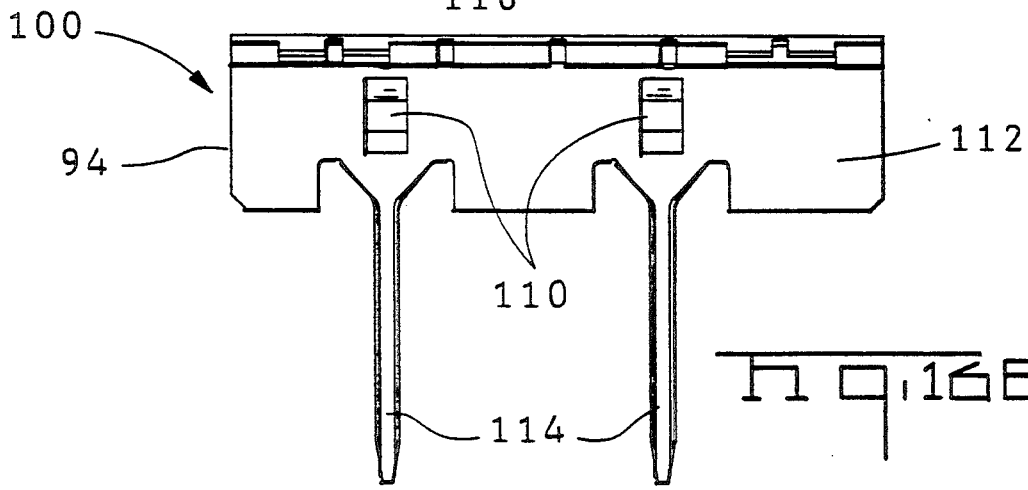
Fig. 16B
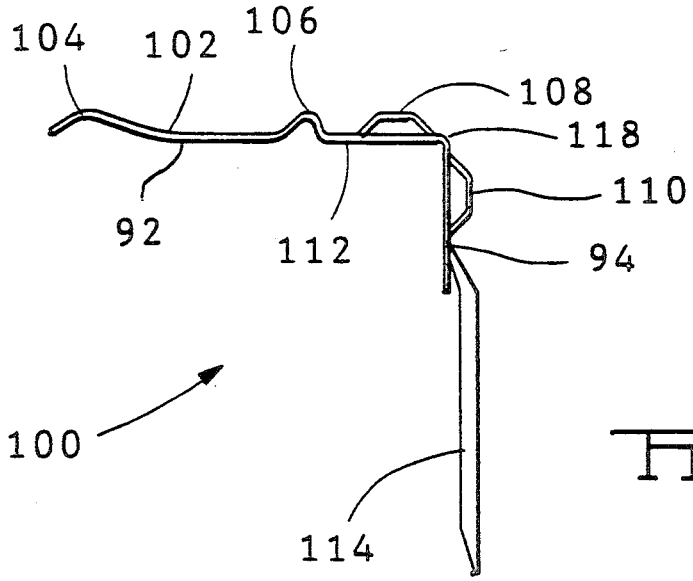
Fig. 16C

Fig. 20A
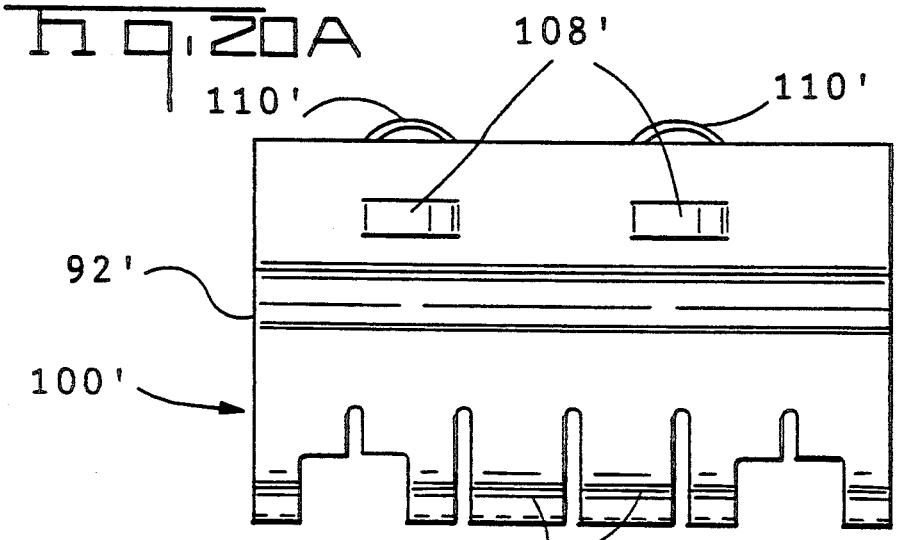
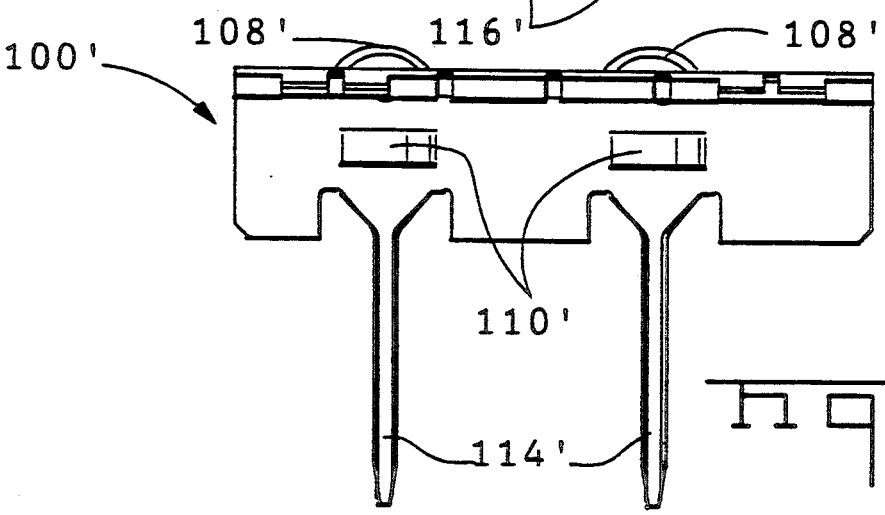
Fig. 20B
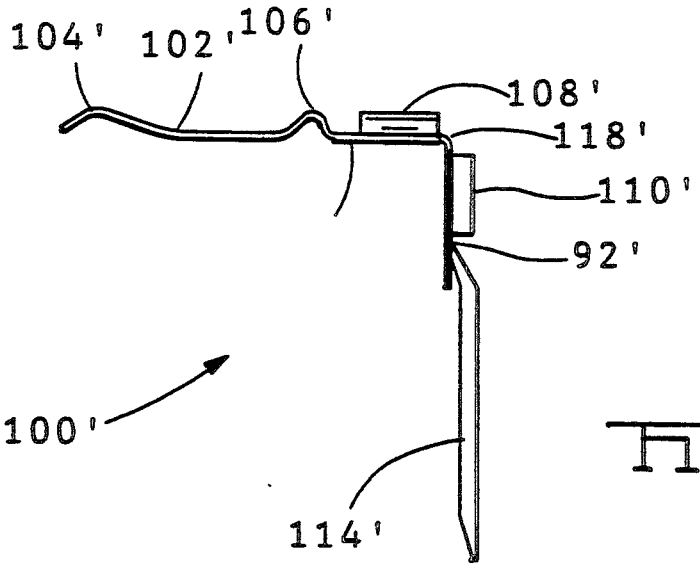
Fig. 20C

RIGHT ANGLE IMPEDANCE MATCHED ELECTRICAL CONNECTOR

This application is a continuation of application Ser. No. 07/519,367 filed May 4, 1990, now abandoned.

BACKGROUND OF THE INVENTION

1. Field of the Invention

This invention relates to an electrical connector assembly employed to make electrical connections in a plurality of electrical signal lines in which the impedance of the signals transmitted through the connector varies insignificantly from the impedance of the interconnected signal lines and more particularly the electrical connector embodying this invention is intended for use in making a right angle interconnection between two orthogonal conductor arrays such as two printed circuit boards or a printed circuit board and a flat transmission cable.

2. Description of the Prior Art

U.S. Pat. No. 4,762,500 and U.S. Pat. No. 4,747,787 depict electrical connectors intended for the impedance matched electrical interconnection of a plurality of circuits, either on a pair of printed circuit boards or between a transmission cable and a printed circuit board. These connectors employ a central ground bus having a plurality of receptacle signal terminals located in parallel rows on opposite sides of the central ground bus. Both the receptacle terminals and the ground busses of mating connector halves are fully mateable so as to maintain the same impedance between the two connectors. Each connector generally employs microstrip transmission principles to establish an interconnection, thus minimizing changes in impedance between the incoming component, either a cable or a printed circuit board, and the outgoing component, again either a cable or the circuits on a printed circuit board. U.S. Pat. No. 4,695,106 and U.S. Pat. No. 4,762,500 in particular disclose electrical connectors for making a plurality of electrical connections between multiple signal lines on two orthogonally oriented printed circuit boards.

It has proved difficult to achieve the required impedance levels in a manufacturable product employing the components depicted in those patents. A better understanding of the elements of a truly manufacturable matched impedance connector has now been achieved. It has been found that a connector designed in accordance with established geometrical relationships used for microstrip printed circuit board design does not result in a microstrip connector design having acceptable performance. Unlike a microstrip circuit board, electrical connectors have no signal conductors or ground conductors in intimate contact with surrounding dielectric material. Air spaces between metal and plastic, resulting from tolerances or the need to accommodate thermal expansion differentials, affect the dielectric constant of housing materials to a different extent than air above a circuit board trace and the substrate below that trace. Furthermore dielectric material exists above the connector signal contacts while no dielectric is present in that location for microstrip circuit boards. In part, these differences account for some of the inadequacies of conventional microstrip formula when applied directly to an electrical connector employing microstrip principles.

It has been found however that by positioning the inner peripheral surface of receptacle signal terminals closer to an outer peripheral surface of a receptacle ground bus than the spacing between adjacent surfaces of signal terminals, the desired characteristic impedance can be achieved, especially if spacings between signal terminals and the receptacle housing ground bus are maintained substantially constant, at least for incremental lengths greater than the wavelength of signals to be transmitted. The preferred embodiment of the invention depicted herein comprises a practical and manufacturable electrical connector assembly which can be used to interconnect circuits having an impedance of 50 ohms and the connector depicted herein will remain substantially transparent, thus having little or no affect on the signals transmitted through the connector. In particular, the electrical connectors embodying this invention provide a means for maintaining the positional relationship between signal terminals and a parallel ground bus through a right angle without introducing significant differences in the impedance of signals transmitted through the electrical connector.

SUMMARY OF THE INVENTION

The transmission of relatively high speed signals between two orthogonally oriented arrays of signal lines, such as orthogonally oriented printed circuit boards or a flat transmission cable extending at right angles to a printed circuit board, can be accomplished by an electrical connector having a microstrip transmission configuration. One or more rows of signal contacts can be positioned adjacent a ground bus to transmit signals in such a manner. The signal contacts and the ground bus each have a right angle bend intermediate the ends when orthogonally oriented signal arrays are to be interconnected. The signal contacts are positioned within cavities in an insulative housing and the ground bus is positioned within a slot adjacent the row of cavities. In order to maintain the required spacing between signal contacts and the ground bus for microstrip signal transmission, each is urged toward the other. The signal contacts can be urged toward the ground bus, for example by employing a resilient tab engaging the housing to urge the signal contact toward the ground bus. A ground bus formed of two components can be employed with one ground bus component being urged toward the adjacent signal contacts by engagement with the other. If the ground bus is positioned equidistant between two rows of signal contacts, each ground bus could employ a protrusion engaging the corresponding protrusion on the other ground bus component so that each of the two ground bus components can be urged toward the signal contacts most closely adjacent that ground bus component. In an electrical connector having a microstrip signal transmission configuration, the signal contacts and the ground bus are separated by an internal dielectric wall. By maintaining both the the signal contacts and the ground bus in contact with that dielectric wall over substantially the entire length of the signal contacts, variations in impedance along the length of the signal contacts can be reduced so that high speed signals transmitted through the connector will not be distorted.

BRIEF DESCRIPTION OF THE DRAWINGS

FIG. 3 is a side view of the right angle receptacle connector.

FIG. 4 is a sectional view taken along section lines 4-4 in FIG. 1.

FIG. 6 is a sectional view of the assembled connector showing the right angle receptacle connector mated to a pin header. FIG. 6 shows the same section of the receptacle connector as shown in FIG. 5.

FIGS. 8-12 are sectional views taken along section lines 8—8, 9—9, 10—10, 11—11, and 12—12 in both FIGS. 6 and 7. Section lines for FIGS. 6 and 7 are also shown in FIGS. 8-12.

FIG. 13 is a section view of the upper and lower insulative housings for the right angle receptacle connector.

FIGS. 16A-16C are top, rear, and side views respectively of one section of the bottom half of the right angle receptacle connector ground bus.

FIGS. 20A-20C are top, rear and side views respectively of one section of the bottom half of another embodiment of the right angle ground bus.

DETAILED DESCRIPTION OF THE PREFERRED EMBODIMENT

Figures 1, 2:
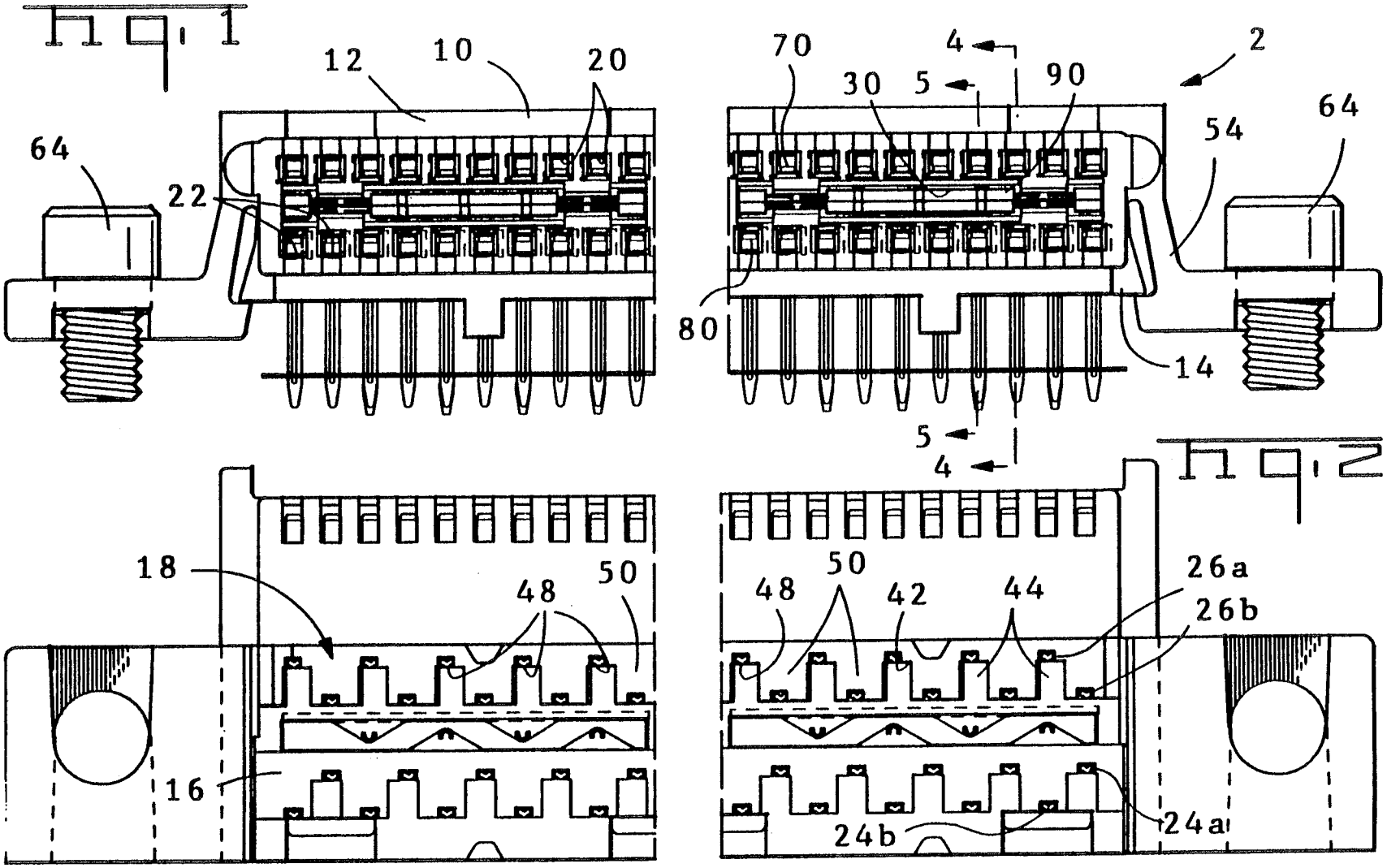
FIG. 1 is a front view of the right angle receptacle connector showing the mating face of the receptacle connector.
FIG. 2 is a bottom view of the right angle receptacle connector showing the staggered lead configuration.
Figure 7:
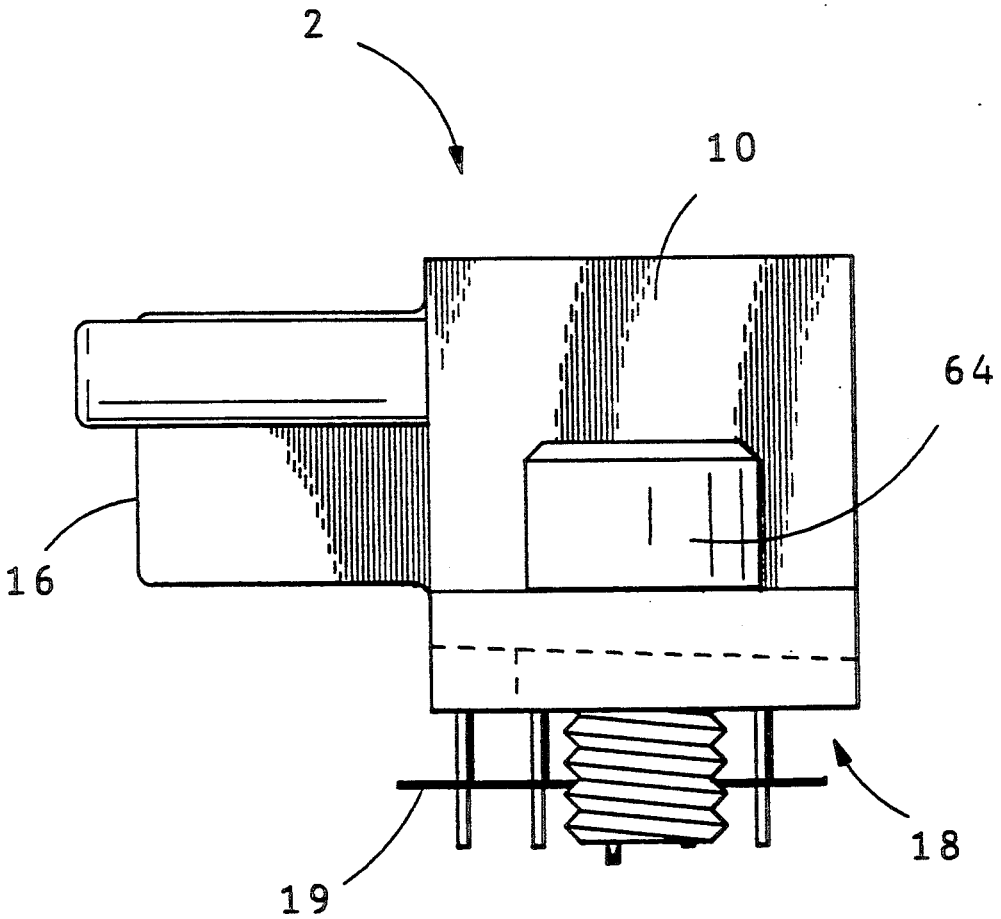
FIG. 7 is a section view of the assembled connector similar to FIG. 6, but showing the same section of the receptacle connector as shown in FIG. 4.

The preferred embodiment of this invention comprises an electrical connector 2 which can be used to interconnect two arrays of conductors such as two printed circuit boards, which uses a micro strip configuration to closely match the impedance of individual signal lines in the array of conductors. Electrical connector 2 is specifically intended to make a right angle interconnection. Receptacle connector 2 can be mated with a mating connector, such as a pin header 4 which is secured to another printed circuit board. The electrical connector 2 comprises an insulative housing 10 containing a plurality of signal terminals 70,80, which in the preferred embodiment are located in two rows within cavities 20,22 of the insulative housing 10. Receptacle connector 2 also includes a ground bus 90 which is located between the two rows of signal contacts within a slot 30 positioned between the cavities 20 and 22.

Figure 5:
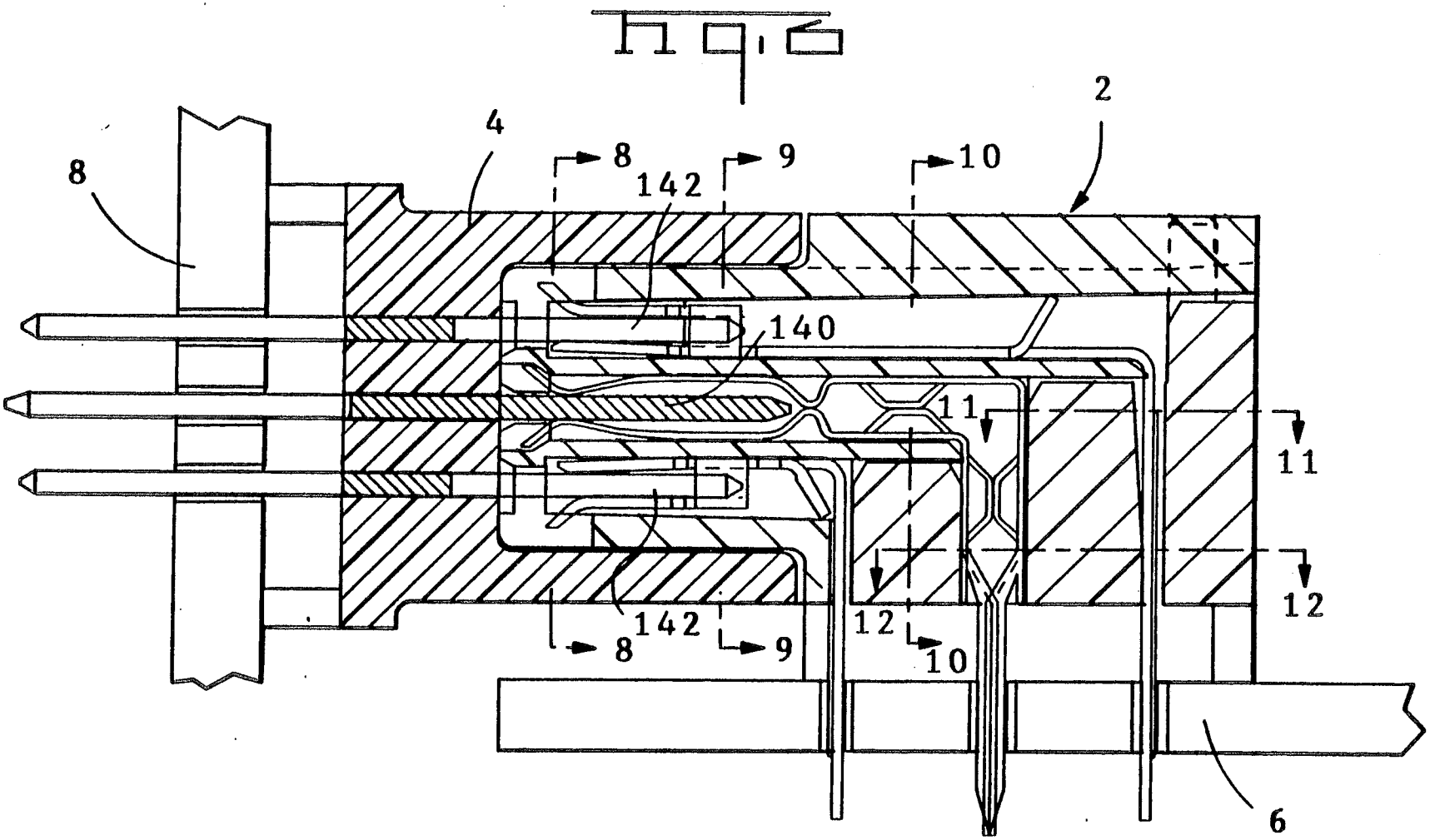
FIG. 5 is a sectional view taken along section lines 5-5 in FIG. 1.
Figure 7:
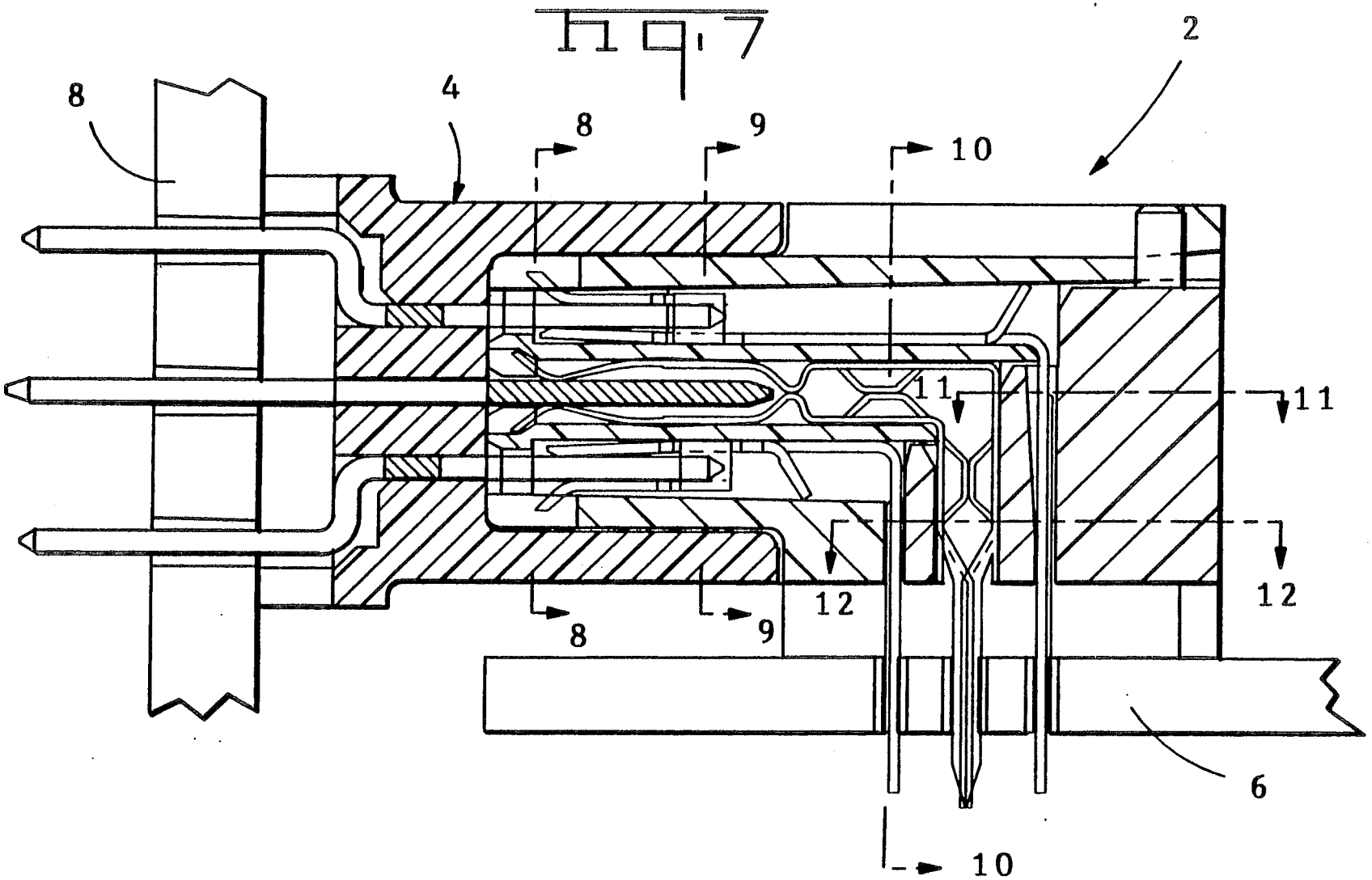
Figure 11:
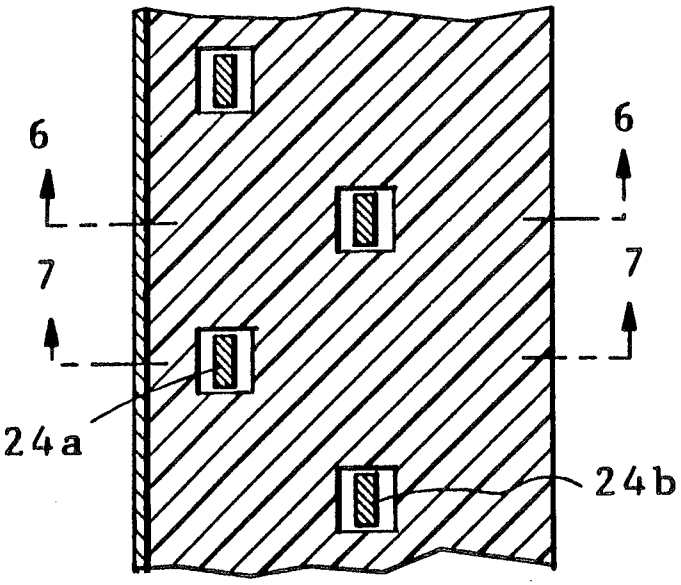
Figure 10:
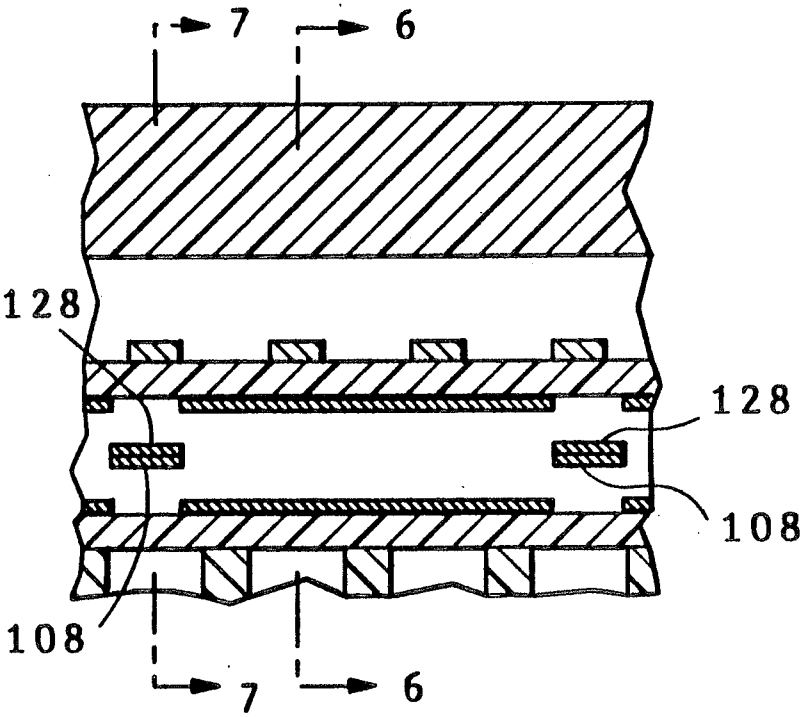
Figure 12:
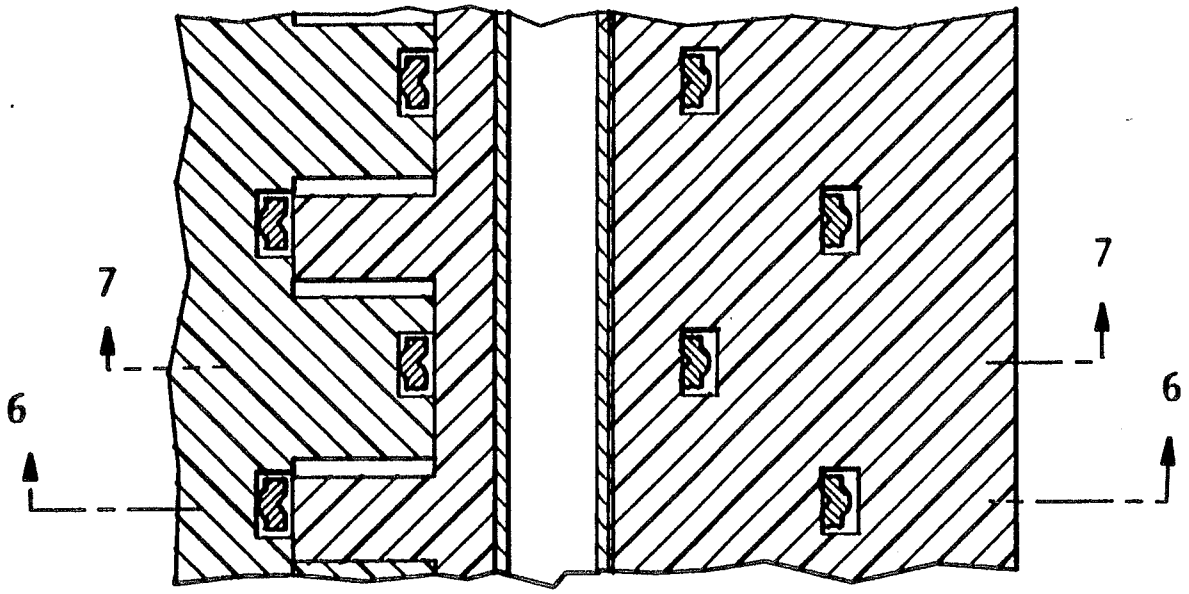

The insulative housing 10, comprises an upper housing member 12 and a lower housing member 14. The upper housing member 12 includes a plurality of contact cavities 20,22 located in two rows on opposite sides of the ground bus slot 30. As shown in FIGS. 4 and 5 the lower housing member is attachable to the upper housing member at right angles and it includes a plurality of outer cavity extensions 24*a* and 24*b* and inner cavity extensions 26*a* and 26*b*. The cavity extensions 24*a* and 24*b* communicate at right angles with the upper housing cavity 20 and the upper housing member 12. As shown in FIGS. 4 and 5 and in FIG. 15, the lower housing cavity extensions 24*a* and 24*b* on the outer portion of the lower housing member 14 are staggered so that each cavity 24*a* is more closely adjacent the ground bus 90 than the adjacent outer cavity extension 24*b*. The inner cavity extension 26*a* and 26*b* which communicates with the lower cavity 22 are staggered in the same manner. By staggering the lower housing cavity extension 24*a*, 24*b*, 26*a*, 26*b* the signal contacts can be staggered thus accommodating wider center lines on the printed circuit board in which the receptacle connector 2 is mated, while the side to side spacing of the mating portion of the signal contact 70 and 80 can be retained. In the preferred embodiment of this invention as seen in FIGS. 1-3, the signal contacts at the connector mating base 16 of receptacle connector 2 are positioned in two rows on 0.050 inch center line. At the board mating face 18 of the receptacle connector 2, the signal contacts are positioned on a staggered 0.100 inch center line spacing which is compatible with conventional printed circuit board construction.

Figure 15:
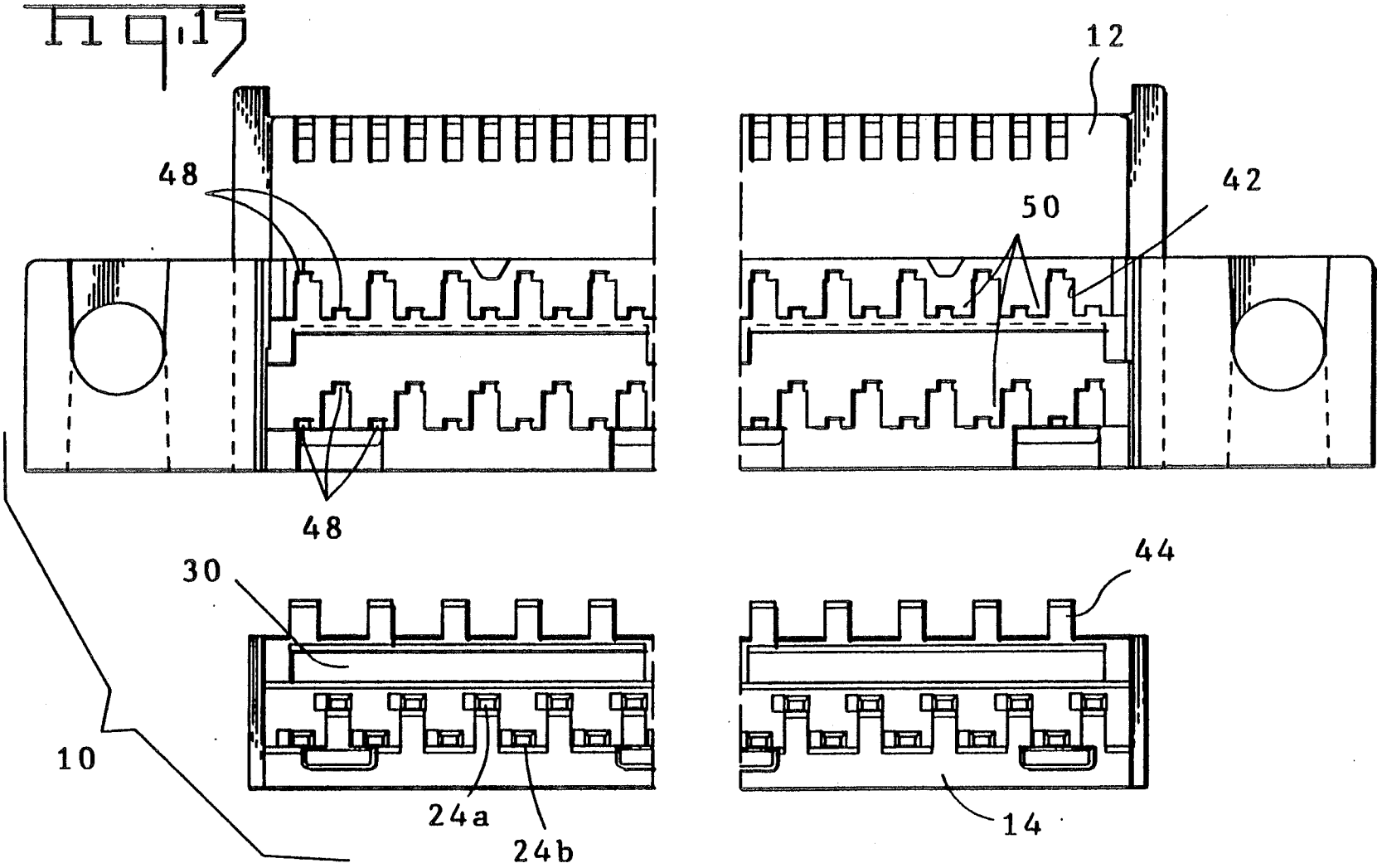
FIG. 15 is a bottom view of the upper and lower insulative housings for the right angle receptacle connector. This view is not arranged in an exploded configuration. The upper and lower housings are mated by movement perpendicular to the planes of the view.

As shown in FIG. 13, the two housing members 12,14 are joined on abutting section 38,40 with the cavities 20 and 22 and the upper housing member on one side of the abutting sections 38,40 extending at right angles to the cavity extension 24*a*, 24*b*, 26*a*, 26*b* and the lower housing member 14 on the other side of the abutting sections 38,40. Each of the cavities 20,22 and the upper housing member 12 are separated from a central slot 30 extending between the two rows of cavities by interior housing slot walls 32 and 34. Adjacent cavities 20,22 in each row are separated by walls 36 extending perpendicular to the interior slot walls 32 and 34. As shown in FIG. 15, the cavity extensions 24*a* and 24*b* located on the exterior of the slot 30 in the lower housing member 14 each comprise holes extending through the body of the lower housing member 14. As shown in FIG. 1, the cavity extension 26*a* and 26*b* in the portion of the insulative housing 10 extending between the board mating face 18 and the abutting section 40 of the lower housing member 14 are defined by the engagement of the upper housing member 12 and the lower housing member 14. A plurality of signal lead support grooves 42 as shown in FIG. 15 are formed on the rear of the upper housing member 12. Mating signal lead support tongues 44 are formed on the outwardly facing side of the lower housing member 14. These tongues 44 fit within the grooves 42 when the lower housing member 14 is attached to the upper housing member 12 to form the insulative housing 10. Signal lead apertures 48 which comprise channels, receive the lead portions of the signal contacts 70 and 80. Note that the engagement of tongue 44 with signal lead support grooves 42 permits receipt the leads in the cavity extension 26*b* located most closely adjacent to the ground bus 90. Ridges 50 on the upper housing member 12 also contain signal lead aperture channels 48, and cooperate with the lower housing member 14 to receive the signal contact leads 26*a* in the outer most row of the lower portion of housing 10. The interfitting of the upper housing member 12 and the lower housing member 14 to position the lead sections of the signal contacts 80 below the ground bus 90 is clearly shown in the bottom view of the connector 2 shown in FIG. 2.

Figure 14:
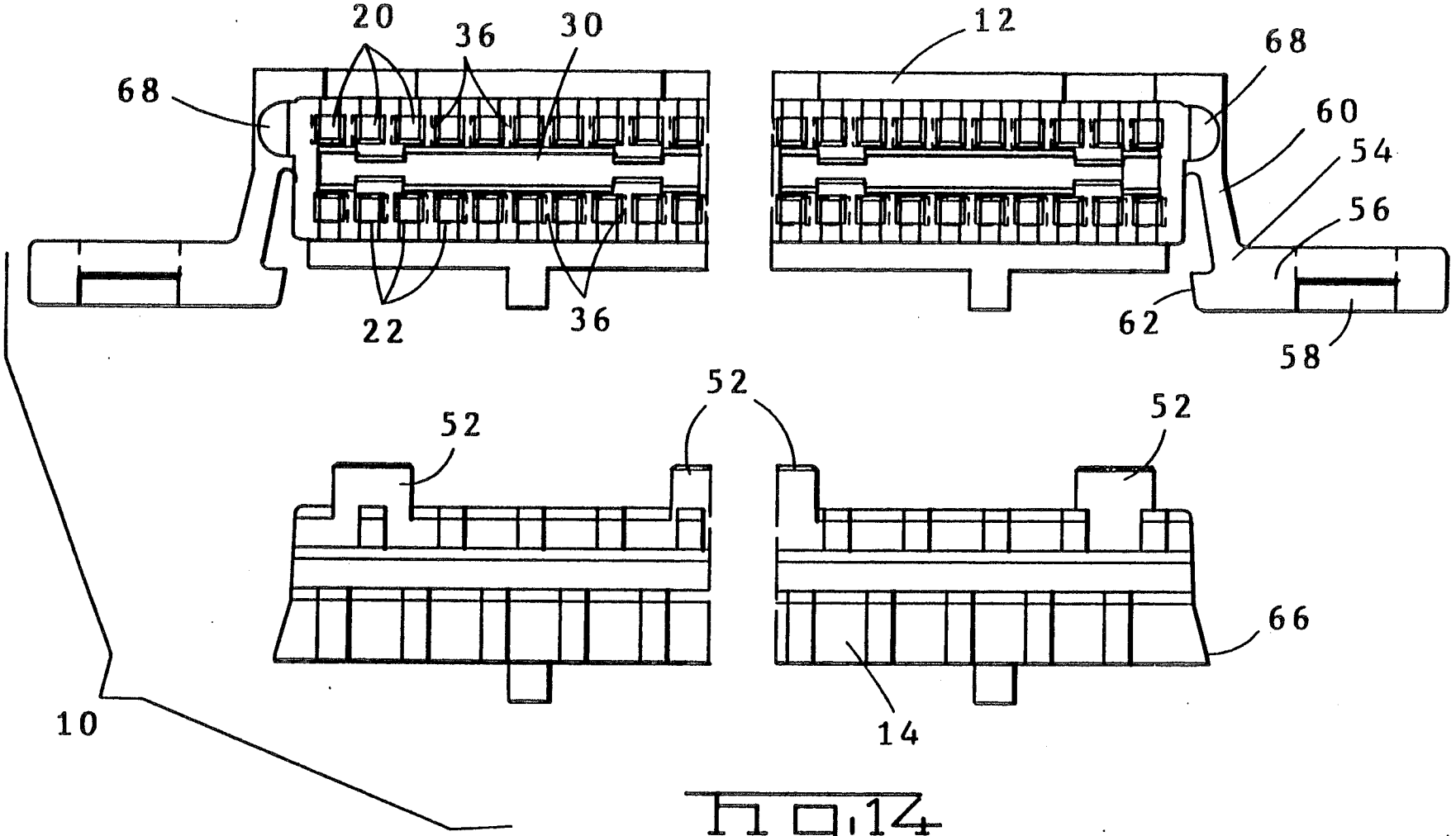
FIG. 14 is a front view of the upper and lower insulative housings for the right angle receptacle connector.

As shown in FIGS. 6 and 14, the receptacle connector 2 is mounted to a printed circuit board 6 by board mounting extensions 54 located on each end of the upper housing member 12. These board mounting extensions 54 also comprise means for holding a lower housing member in engagement with the upper housing member. Board mounting extensions 54 are outwardly deflectable so that the lower housing member can be snap fit into engagement with the upper housing member. As shown in FIG. 14, the board mounting extensions 54 each comprise resilient arms 60 from which a pedestal 56 extends. In the preferred embodiment of this invention, pedestal 56 includes a hole 58 suitable for receiving a post such as a screw 64 (see FIG. 1) which extends through the hole 58 and pedestal 56 and comprises part of the board mounting means. It should also be understood that an integral extension could be formed on the board mounting means suitable for establishing interference fit with a hole in the printed circuit board 6. A inwardly extending flange 62 on the resilient arms 60 provides a means for securing the lower housing member 14 to the upper housing member 12. Outwardly extending ribs 66 are located on the lower housing member 14 which cooperate with the flange 62 to secure the lower housing member 14 to the upper housing member 12. Movement of the lower housing member 14 upwardly into engagement with the upper housing member 12 causing a resilient arm 60 to be cammed outwardly by the engagement of ribs 66 with the flanges 62. Once the ribs 66 have passed the flanges 62 the resilient arms 60 snap back in to secure the lower housing member 14 to the upper housing member 12. Proper alignment between the upper and lower housing member 12 and 14 is maintained by a mating pin 52 which extend upwardly from the lower housing member 14.

As shown in FIGS. 4 and 5 signal contacts 70 are positioned within insulative housing 10 on the exterior of the centrally disposed ground bus 90. Terminal signal contacts 80 are also positioned adjacent the ground bus 90 on the inner or lower portion of the insulative housing 10. Signal terminals 70 are positioned within cavities 20 an lower housing cavity extensions **24*a* and 24*b*. Similarly signal contacts 80 are positioned within cavities 22 and the lower housing inner cavity extension 26*a* and 26*b*. Each of the signal contacts 70,80 has a right angle bend located adjacent the junctional or abutting section 38,40 of the upper housing member 12 and the lower housing member 14. Signal contact 70 and 80 have contact mating sections 72,82 positioned with the upper housing member and extending between the abutting sections 38,40 and the mating face 16. Each signal contact 70,80 also has a contact lead section 74,84 extending at right angles to the contact mating section 72,82 and extending into the lower housing member between the abutting sections 38,40 and the board mounting face 18 of the receptacle connector 2. Adjacent signal contact leads in each row are staggered in the same pattern as the staggering of the cavities in the infrared housing. Each signal contact has a tab 76,86 which comprises means for urging the signal contacts inwardly toward the ground bus 90. Tabs 76,86 are located adjacent to the contact mating section 72,82 and each urges the signal contact adjacent the mating section 72,82 inwardly toward the ground bus 90 and against the adjacent slot wall 32,34 to reduce variations in impedance along the length of the signal contacts. The tabs 76,86 engage the side of the respective cavities 20,22 located opposite from the interior slot wall 32,34 between the cavities 20,22 and the slot 30. Tabs 76 and 86 also hold the signal pins in the housing until assembly is complete. Note that the upper signal contacts 70 are urged downwardly, as shown in FIG. 4, while the lower signal contacts 80 are urged upwardly toward the ground bus 90. Signal contacts also have right angle bends 78,88 located intermediate their ends. Since adjacent signal contacts are staggered, as shown in FIGS. 4 and 5**, the position of the right angle bend relative to the mating section is different for longer and shorter adjacent signal contacts.

Figure 17:
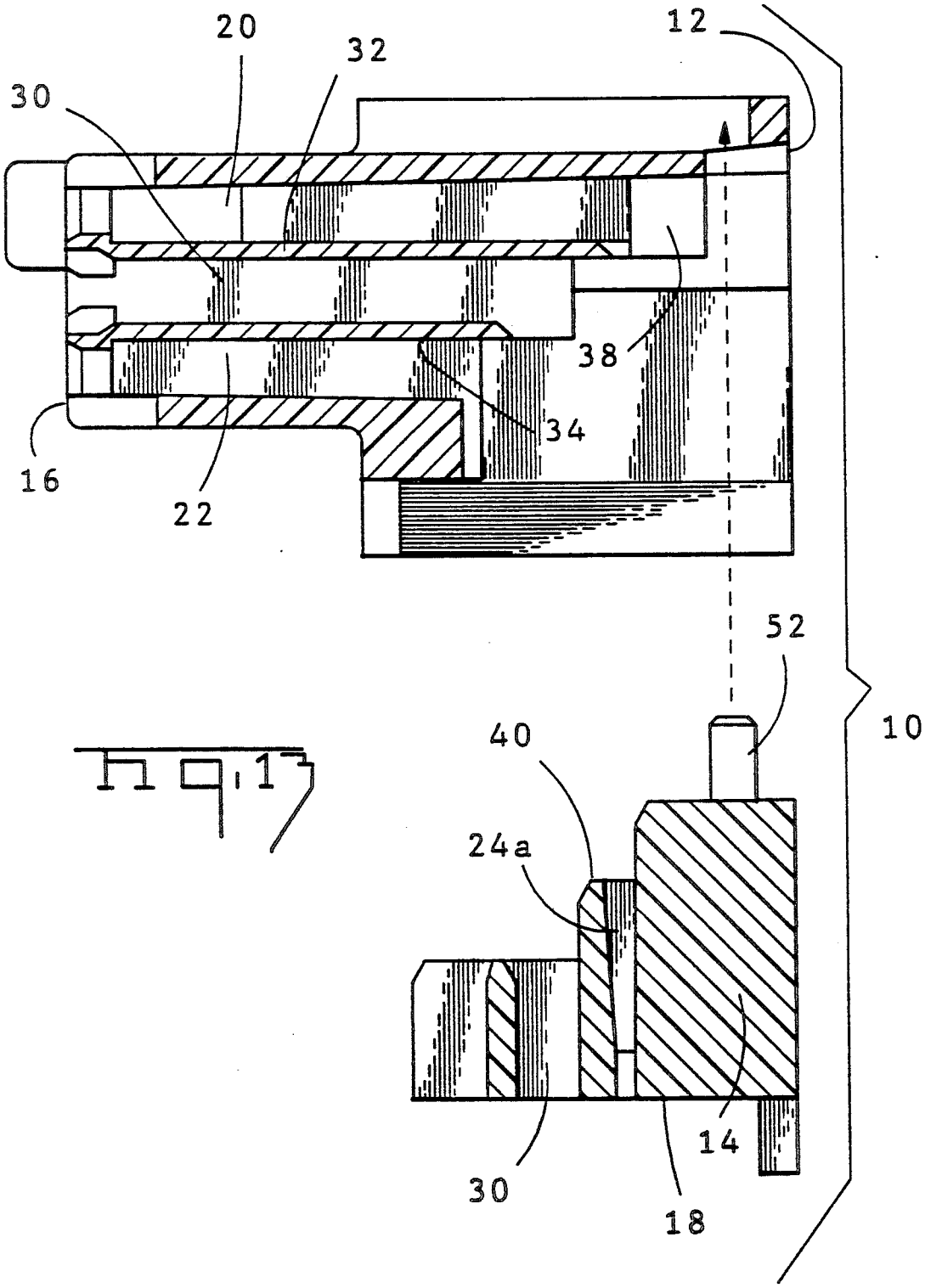
FIGS. 17A-17C are top, front, and side views of one section of the top half of the right angle receptacle connector ground bus.
Figure 17A:
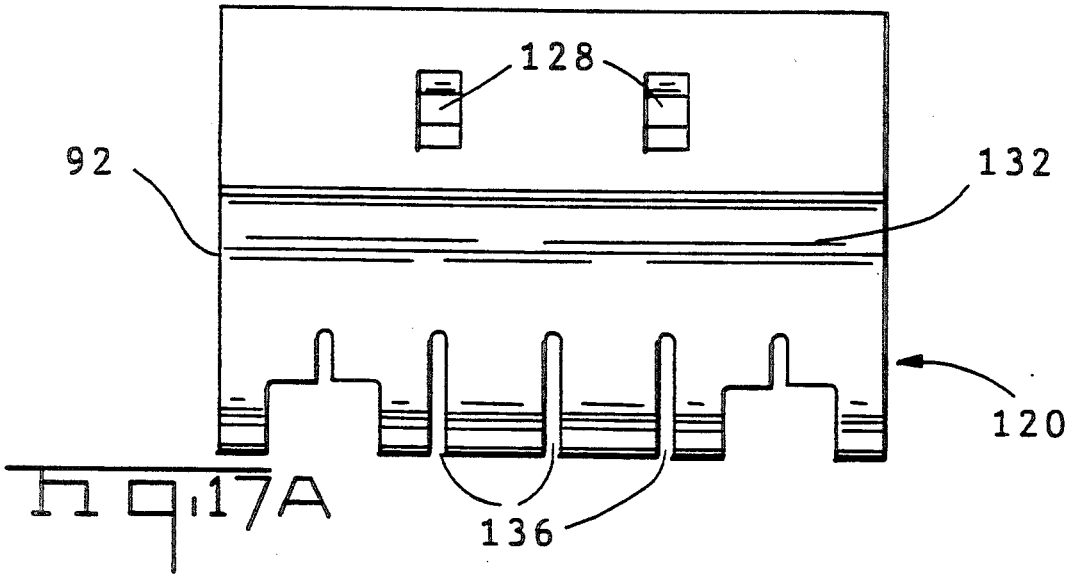
Figure 17B:
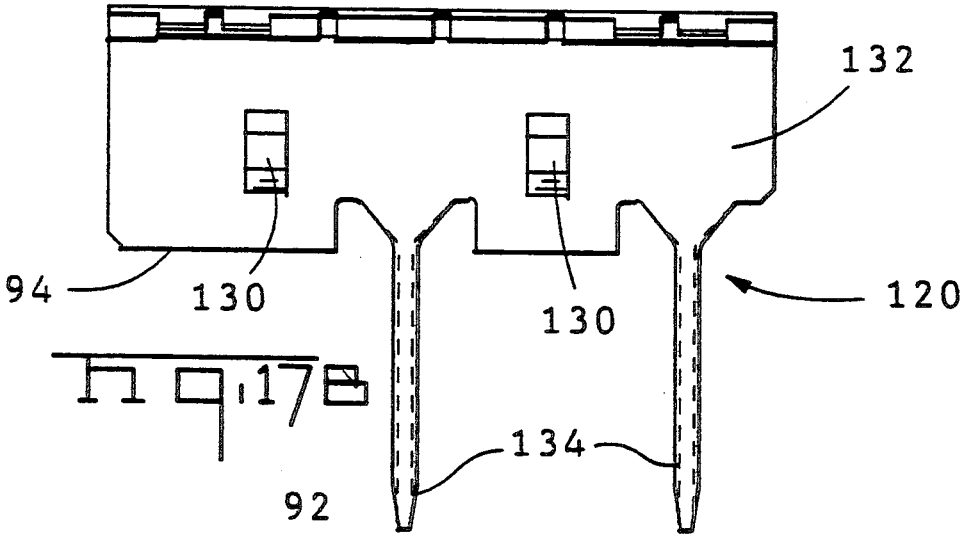
Figure 17C:
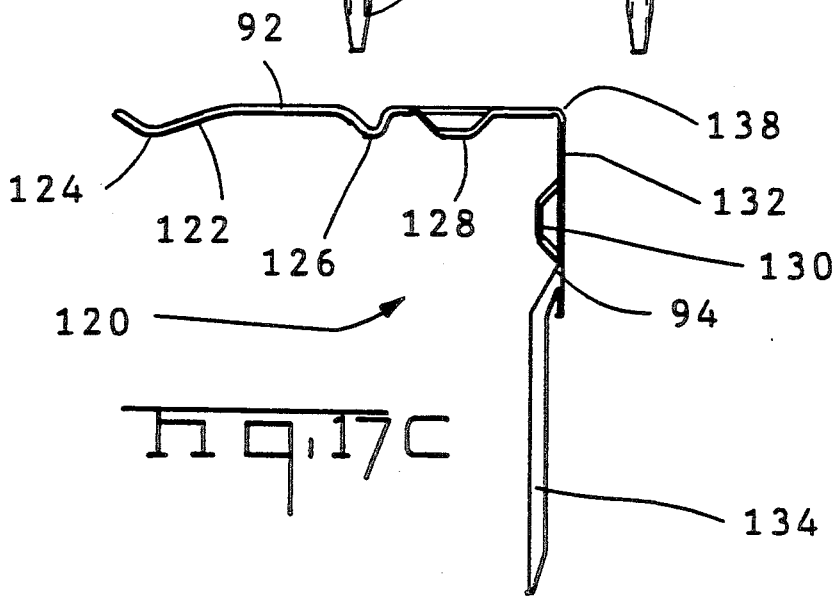
Figure 18:
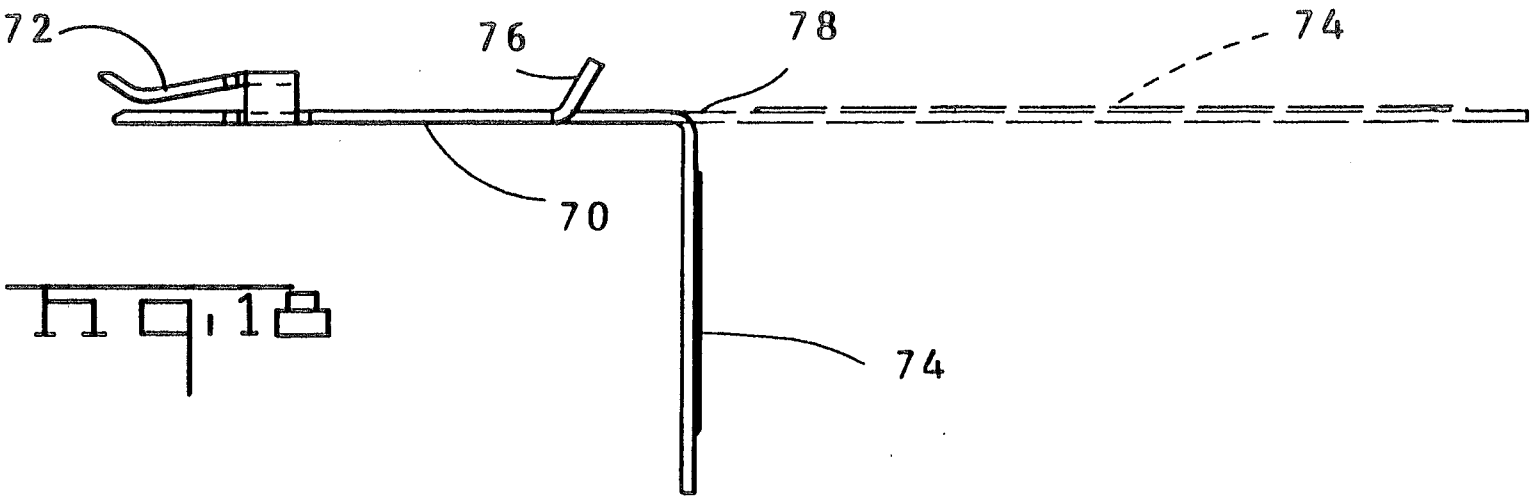
FIG. 18 is a side view of the upper signal contact employed in the right angle receptacle connector.
Figure 19:
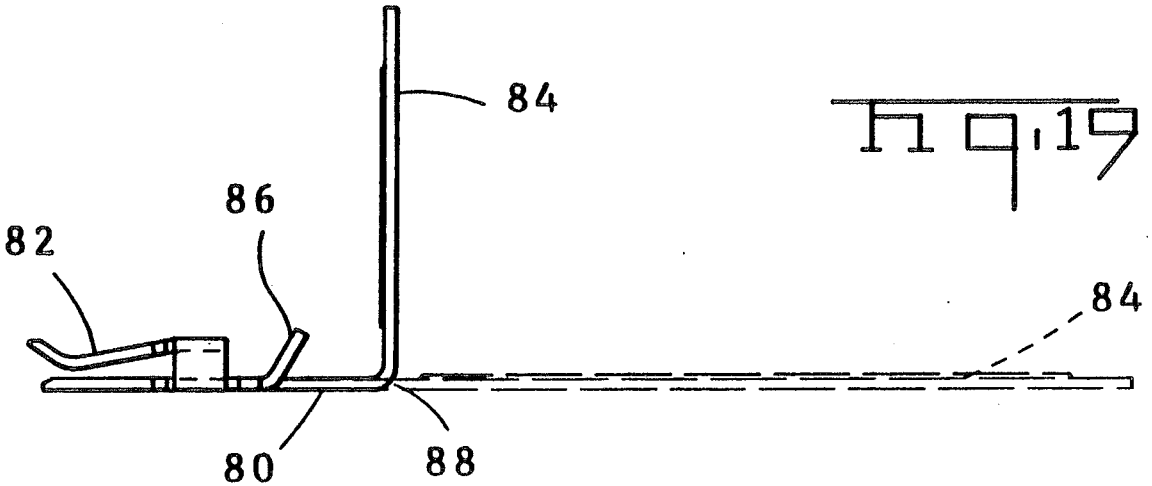
FIG. 19 is a side view of the lower signal contact employed in the right angle receptacle connector.

Ground bus 90 located within slots 30 also has a right bend located along the junction or abutting sections 38,40 between the upper housing member 12 and the lower housing member 14. Ground bus 90 is centrally located within the receptacle connector housing 10 and comprises a lower bus component 100, shown in FIGS. 16A–16C, mating with a upper bus component 120 shown in FIGS. 17A–17C to form a single ground bus. Each ground bus component 100,120 includes a blade section 112,132, which contains the bus mating section 92 positioned within the upper housing member 12, and a bus lead section 94 which includes leads 114,134. Each bus component 100,120 includes a right angle bend 118,138 intermediate the opposite ends of the bus component in the blade section 112,132. Leads 114,134 extend downwardly from the edge of the blade section 112,132 in the bus lead section 94 of each bus component. The bus mating section 92 comprises an inwardly formed section 102,122 of the spring metal contact. Contact points 104,124 are located at the innermost extension of each bus mating section 92. Contact points 104 and 124 are opposed and the bus mating springs 102,122 are flexible outwardly relative to the center line of the slot 30. Separate fingers 116,136 are formed in each bus mating section. Each bus mating section 92 extends generally from an inwardly extending dimple 106,126, and a portion of the bus mating section 94 between the dimple 106 and the inwardly deflected spring 102 normally rests against the slot walls 32,34. A plurality of protrusions 108, 110, 128, 130 are formed out of the plane of the blade section and comprise means for urging the ground bus component 100,120 into engagement with the slot walls 32,34. Each protrusion engages the other bus component to position each ground bus component closely adjacent one of the rows of signal contacts 70,80 to reduce variations in impedance along the length of the signal contacts 70,80. The protrusions 108, 110, 128, 130 are located within the blade sections 112, 132. Protrusions 108, 128 are located in the bus mating section 92 while protrusions 110,130 are located in the bus lead section. As shown in FIGS. **16*a*, 16*b* and 17*a*, 17*b* two protrusions are formed along the width of the ground bus. Also two protrusions are formed along the length of the ground bus. Protrusions 108,110 are on opposite sides of the right angle bend 118 and protrusions 128,130 are also on opposite sides of the right angle bend 138. Thus each ground bus has at least one protrusion extending transverse of the bus mating section and one protrusion extending transverse to the bus lead section. Since the protrusions 108, 110, 128, 130 act to urge the ground bus component 100,120 outwardly into engagement with the slot walls 32,34, while the tabs 76,86 similarly tend to urge the signal contacts 70,80 into engagement with the slot walls 32,34, the spacing between the signal contacts 70,80 and the ground bus 90**, tends to remain constant.

Figure 21A:
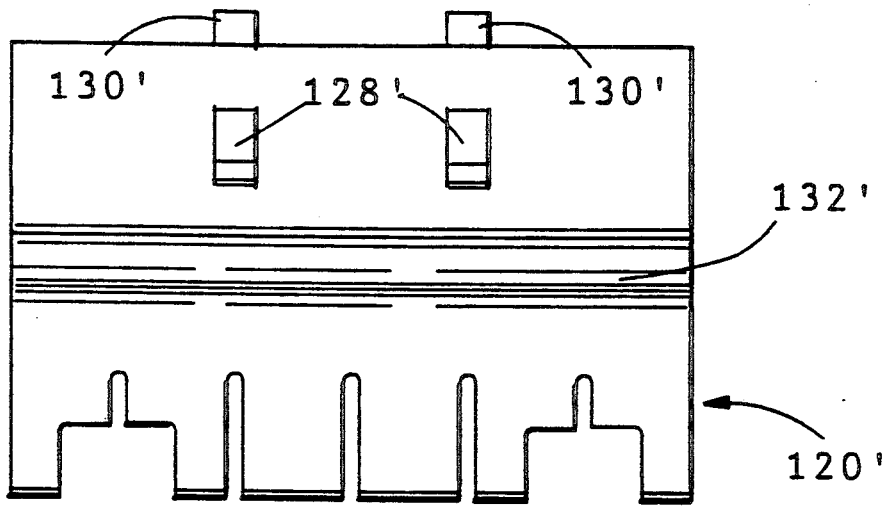
FIGS. 21A-21C are top, front and side views respectively of one section of the top half of another embodiment of the right angle ground bus.
Figure 21B:
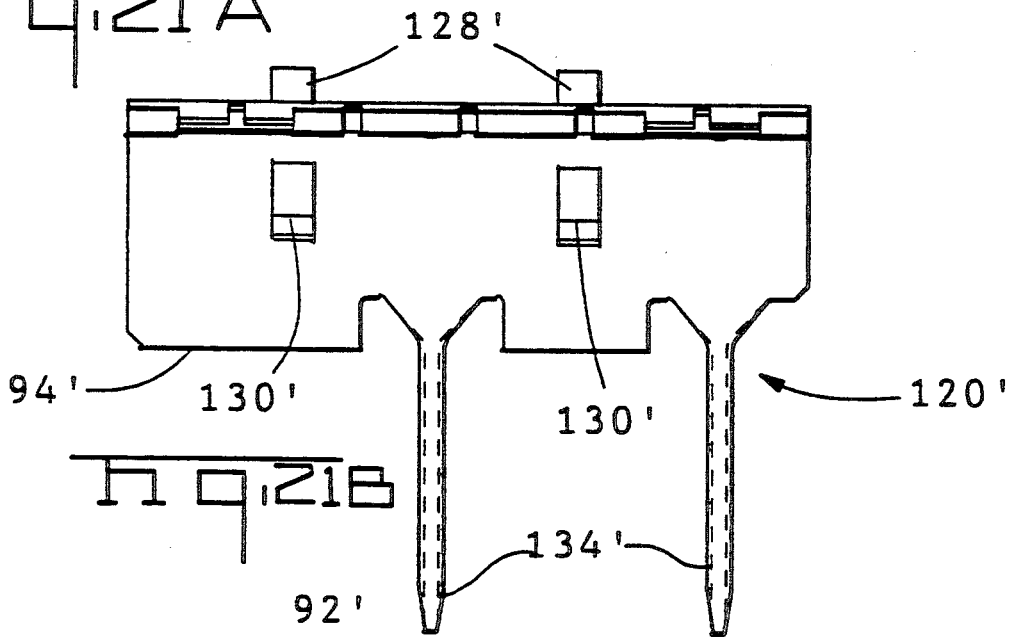
Figure 21C:
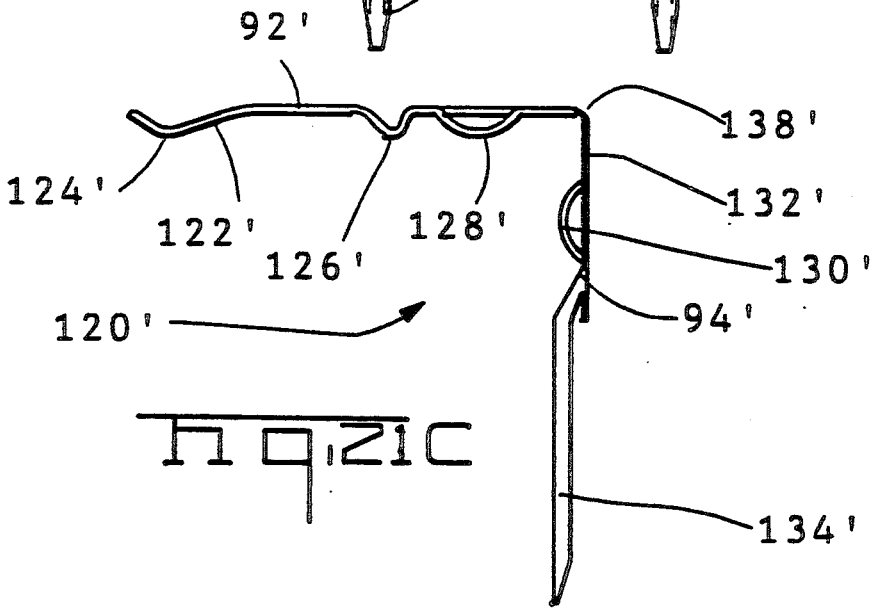
Figure 22:
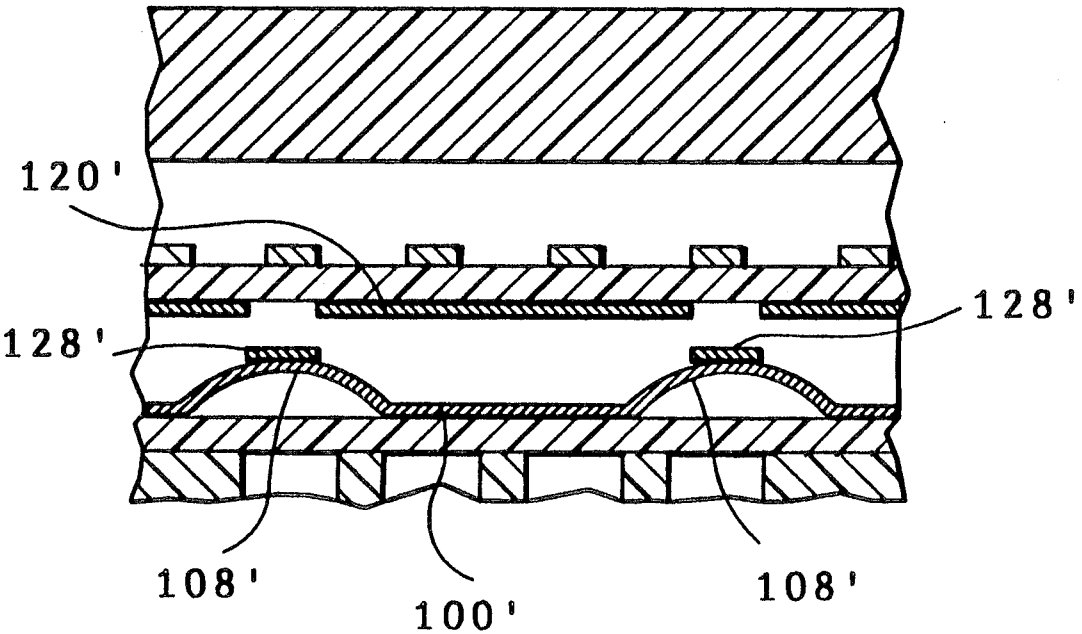
FIG. 22 is a sectional view of the two ground bus sections shown in FIGS. 20A-20C and FIGS. 21A-21C, showing the curved protrusions.

Another embodiment of a ground bus, comprising two sections 100' and 120', is shown in FIGS. 20–22. In this embodiment, protrusions 108', 110', 128' and 130' are curved. As shown in FIGS. 20 and 22, the protrusions 108' and 110' extend transverse to the leads 114' and will extend at right angles to the protrusions 128' and 130' on the mating bus half. Since the remaining elements of the alternative bus sections are the same as the embodiments of FIGS. 16 and 17, primed numerals are used to identify corresponding elements.

In this manner the relationship between each row of signal contacts in the centrally exposed ground bus tends to be that of a microstrip signal transmission configuration in which the signal contacts are located parallel to a ground bus. The blade sections 112,132 are urged outwardly into engagement with the insulative material between the signal contacts and the ground bus along a large portion of their length between the forward mating face 18 and the board mating face 16. Admittedly the resilient mating springs 102,122 on the bus mating component diverge from the slot walls 32,34 when the connector is in the unmated configuration. A comparison between FIGS. 4 and 5 and FIGS. 6 and 7 shows, however, that when the receptacle connector 2 is mated with a mating connector 4 containing a substantially flat ground member 140, the mating springs 102,122 are deflected outwardly so that the spacing in this section of the ground bus component 100,120 is similar to the spacing along the remainder of the blade section 112,132. FIGS. 8 through 12 represents section views at various positions along the mated connector and each shows that a substantial microstrip configuration can be maintained along substantial portions of the length of the signal contact 70,80. The engagement of opposed protrusions 108,128 in the bus component 100,120 is clearly shown in FIG. 10. Pre-loading of ground bus fingers improves normal forces.

A pin locator (film strip) 19 is shown in FIG. 3. This pin locator prealigns the through hole legs of the signal contacts and legs 114, 134 on the ground bus with holes in the printed circuit board on which the connector 2 is to be mounted. Solder preforms can be positioned on the film strip which forms this pin locator. The solder preforms or donuts are then in position to be reflowed when heated. The film strip 19 is shiftable upwardly on the leads and in the upper position, it covers the bottom of slot 30, to prevent the entry of contaminants.

Although the preferred embodiment of this invention comprises a board to board electrical connector it should be understood that a receptacle connector 2 could also be used to form an electrical connection between a printed circuit board such as printed circuit board 6 and a flat cable connector. It should also be understood that means for urging the ground bus outwardly engagement with intervening slot walls as well as means for urging signal contacts inwardly into engagement with the same dielectric walls to maintain a microstrip configuration could be employed not only at a right angle connector such as a receptacle connector 2 but could also be employed in a straight through vertical connector in which interconnection is to be made to two parallel arrays of signal conductors.

We claim:

1. An electrical connector in which signal contacts arranged in at least one row are positioned adjacent a ground bus, the signal contacts of said one row being separated from the ground bus by a first dielectric wall, said ground bus comprising two separate mutually opposed members each of which has a blade section, each blade section including:

(a) a bus mating section at one end thereof having at least one contact point for mating with a male bus member; and (b) a bus lead section at the other end thereof having at least one lead extending therefrom, at least one of said blade sections having a projection disposed between said contact point and said lead and arranged to engage the other opposed member so that a first of said opposed members is always urged toward and always remains in engagement with said first dielectric wall, thereby reducing variations in impedance and reducing crosstalk along the length of said ground bus.

2. An electrical connector in accordance with claim 1 wherein some of said signal contacts are in a second row and said ground bus being disposed between said tow rows, the signal contacts of said second row being separated from said ground bus by a second dielectric wall, wherein said projection of one opposed member is in said engagement with the other opposed member so that the second of said opposed members is urged against said second dielectric wall.

3. An electrical connector according to claim 1 wherein a said projection is disposed on the blade sections of both said opposed members.

4. An electrical connector according to claim 3 wherein said projection of said first opposed member is in mutual engagement with a corresponding projection of said second opposed member.

5. An electrical connector according to claim 1 wherein said dielectric wall comprises a portion of an insulating housing containing said signal contacts and said ground bus.

6. An electrical connector according to claim 1 wherein said signal contacts and said ground bus each extend through a right angle bend intermediate opposite ends thereof.

7. An electrical connector according to claim 6 wherein said dielectric wall comprises a portion of an insulating housing containing said signal contacts and said ground bus and wherein said housing comprises first and second housing members attachable at right angles.

8. An electrical connector according to claim 7 wherein said insulating housing comprises an upper housing member and a lower housing member, the contact mating section and the bus mating section being disposed within said upper housing member and the contact lead section and the bus lead section extending into said lower housing member.

9. An electrical connector according to claim 1 wherein said at least one blade section includes multiple projections along its width.

* * * * *